US007153062B1

(12) United States Patent
Baumgartner

(10) Patent No.: US 7,153,062 B1
(45) Date of Patent: Dec. 26, 2006

(54) APPARATUS FOR SECURELY SUPPORTING SCUBA TANKS VIA A VEHICLE HITCH

(76) Inventor: Jaimie Joseph Baumgartner, 9368 Leaping Lilly Ave., Las Vegas, NV (US) 89129

( * ) Notice: Subject to any disclaimer, the term of this patent is extended or adjusted under 35 U.S.C. 154(b) by 0 days.

(21) Appl. No.: 11/346,744

(22) Filed: Feb. 2, 2006

(51) Int. Cl.
*B63C 11/02* (2006.01)

(52) U.S. Cl. ..... 405/186; 248/311.2; 224/519; 224/530; 224/533; 224/536

(58) Field of Classification Search ..... 405/186; 248/311.2, 313, 316.7, 154; 224/533, 536, 224/530, 525, 519, 521, 494, 501
See application file for complete search history.

(56) References Cited

U.S. PATENT DOCUMENTS

2006/0006302 A1* 1/2006 Gragg ..... 248/311.2

* cited by examiner

*Primary Examiner*—Frederick L. Lagman
(74) *Attorney, Agent, or Firm*—Ariel S. Bentolila; Bay Area IP, LLC

(57) ABSTRACT

Provided is a vertically adjustable support device for scuba equipment, which attaches to the rear of a vehicle via a hitch receiver to allow the device to be raised or lowered to a convenient usage height for the diver. One implementation includes a vertical support tube that provides a rigid structural support for other components of the scuba tank holder apparatus to be joined to, a slideably joined holder carriage, and a hitch receiving member; in which a first end portion of the hitch receiving member is joined to a lower portion of the vertical support tube, and a second end portion is configured to be operable for being securely joined to a vehicle hitch, thereby structurally supporting the vertical support tube and associated components when joined thereto.

17 Claims, 12 Drawing Sheets

APPARATUS FOR SECURELY SUPPORTING SCUBA TANKS VIA A VEHICLE HITCH

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

FIELD OF THE INVENTION

The present invention relates generally to scuba equipment. More particularly, the present invention relates to a hitch mounted, vertically adjustable scuba unit support and staging device.

BACKGROUND OF THE INVENTION

The present invention allows a scuba diver to safely assemble his equipment at a comfortable height, this is an improvement over the traditional way of assembling scuba equipment. Most divers must place their scuba tank on the ground and assemble their gear while in a bent over position. This puts unnecessary strain on the lower back. Also, after finishing assembling scuba gear, the general practice is to lay the tank, with attached regulators, computers, etc. on the ground. This puts the expensive gear in a position to be stepped on, tripped over or covered in dirt. This could potentially damage critical life support gear and cause personal injury.

In order to perform what is known as "donning" a scuba unit, traditionally, a diver needs a dive buddy to lift and hold the scuba unit, which can weigh up to 50 lbs, while he adjusts it to fit. This puts unnecessary strain on the dive buddy's back. If the diver does not have a dive buddy, the diver must lift and don his gear alone. This is usually accomplished by placing the scuba unit on the bumper or tailgate of a car or truck. This is typically a problem because one must steady the scuba unit and put ones arms through the arm straps of the buoyancy compensator at the same time. This becomes a precarious balancing act as the tank may shift or slip from the bumper or tailgate.

In view of the foregoing, there is a need for a support and staging system for scuba equipment, which keeps the equipment off of the ground to assemble and disassemble the equipment at a comfortable height and allows the diver to safely don and doff the equipment without the help of another person.

BRIEF DESCRIPTION OF THE DRAWINGS

The present invention is illustrated by way of example, and not by way of limitation, in the figures of the accompanying drawings and in which like reference numerals refer to similar elements and in which.

Unless otherwise indicated illustrations in the figures are not necessarily drawn to scale.

SUMMARY OF THE INVENTION

To achieve the forgoing and other objects and in accordance with the purpose of the invention, a variety of techniques for securely attaching and supporting scuba tanks via a vehicle hitch receiver are described.

One aspect of the present invention is to provide a support device for scuba equipment, which holds the equipment off of the ground at a comfortable height for the assembly, donning, doffing, and disassembly of the equipment. Another aspect of the invention is to attach the scuba unit support device to the rear of a vehicle (e.g., a car or truck) via a hitch receiver to allow the scuba unit support device to be raised or lowered to a comfortable height for the diver.

In one embodiment of the present invention, an apparatus for securely holding scuba tanks via a vehicle hitch is proved that includes a vertical support tube that provides a rigid structural support for other components of the scuba tank holder apparatus to be joined to; a holder carriage, the holder carriage being operable for holding at least one the scuba tank and is configured to be structurally suspended on the vertical support tube by slideably joining (e.g., as a sleeve)

thereto; a locking mechanism (e.g., adjustment pins and drilled holes) that is operable for removabley fixing the longitudinal translation of the holder carriage with respect to the vertical support tube; and a hitch receiving member; in which a first end portion of the hitch receiving member is joined (e.g., pivotally and/or with a releasable locking mechanism) to a lower portion of the vertical support tube, and a second end portion is configured to be operable for being securely joined to a vehicle hitch, thereby structurally supporting the vertical support tube and associated components when joined thereto.

Other embodiments of the present invention include the means for achieves the foregoing described functions.

Other features, advantages, and object of the present invention will become more apparent and be more readily understood from the following detailed description, which should be read in conjunction with the accompanying drawings.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments.

Scuba equipment is heavy and generally very difficult for a diver to don and doff without the help of another person. Scuba equipment can also be damaged by dirt if placed on the ground.

Figure 1:
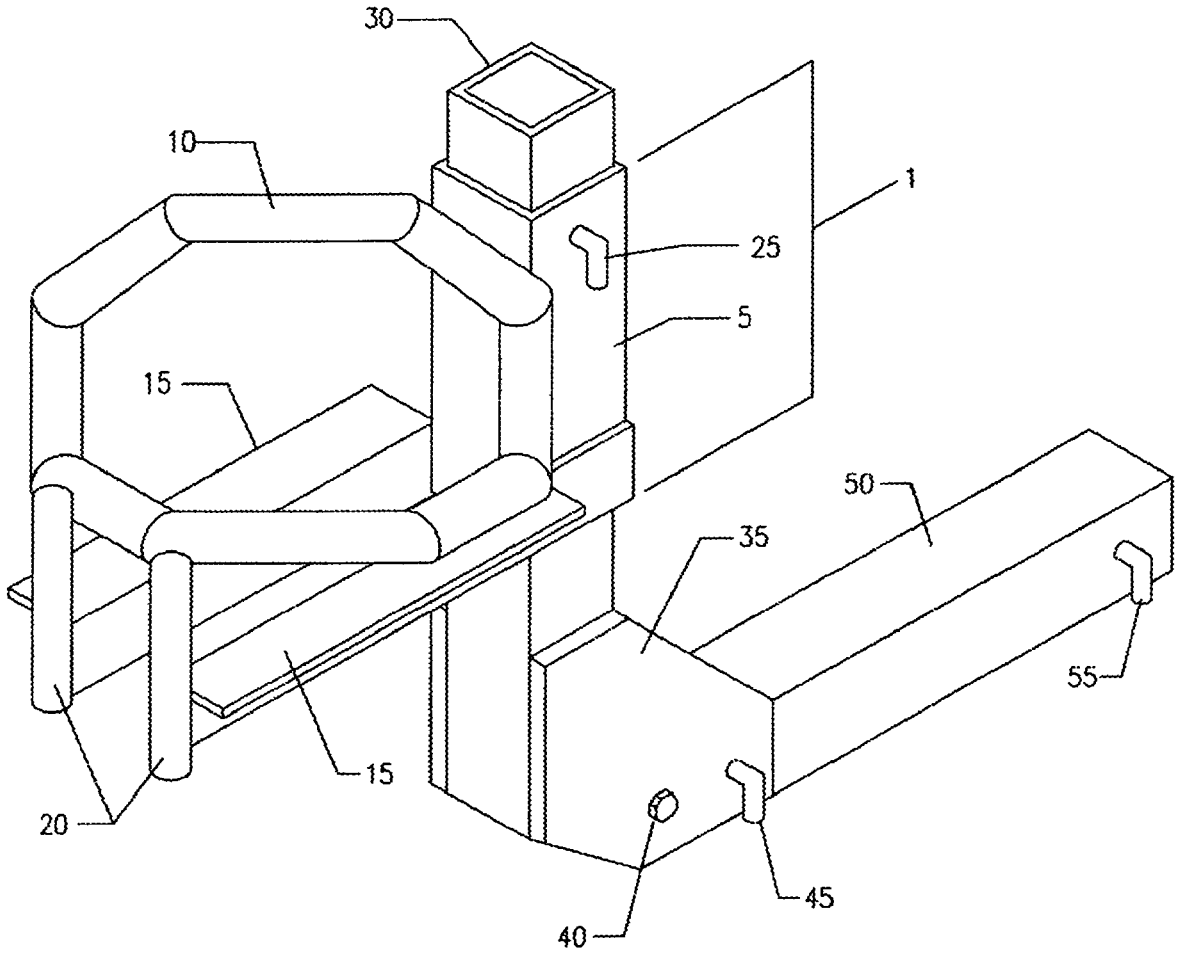
FIG. 1 shows an isometric view of an exemplary scuba unit support device, in accordance with an embodiment of the present invention.
Figure 2:
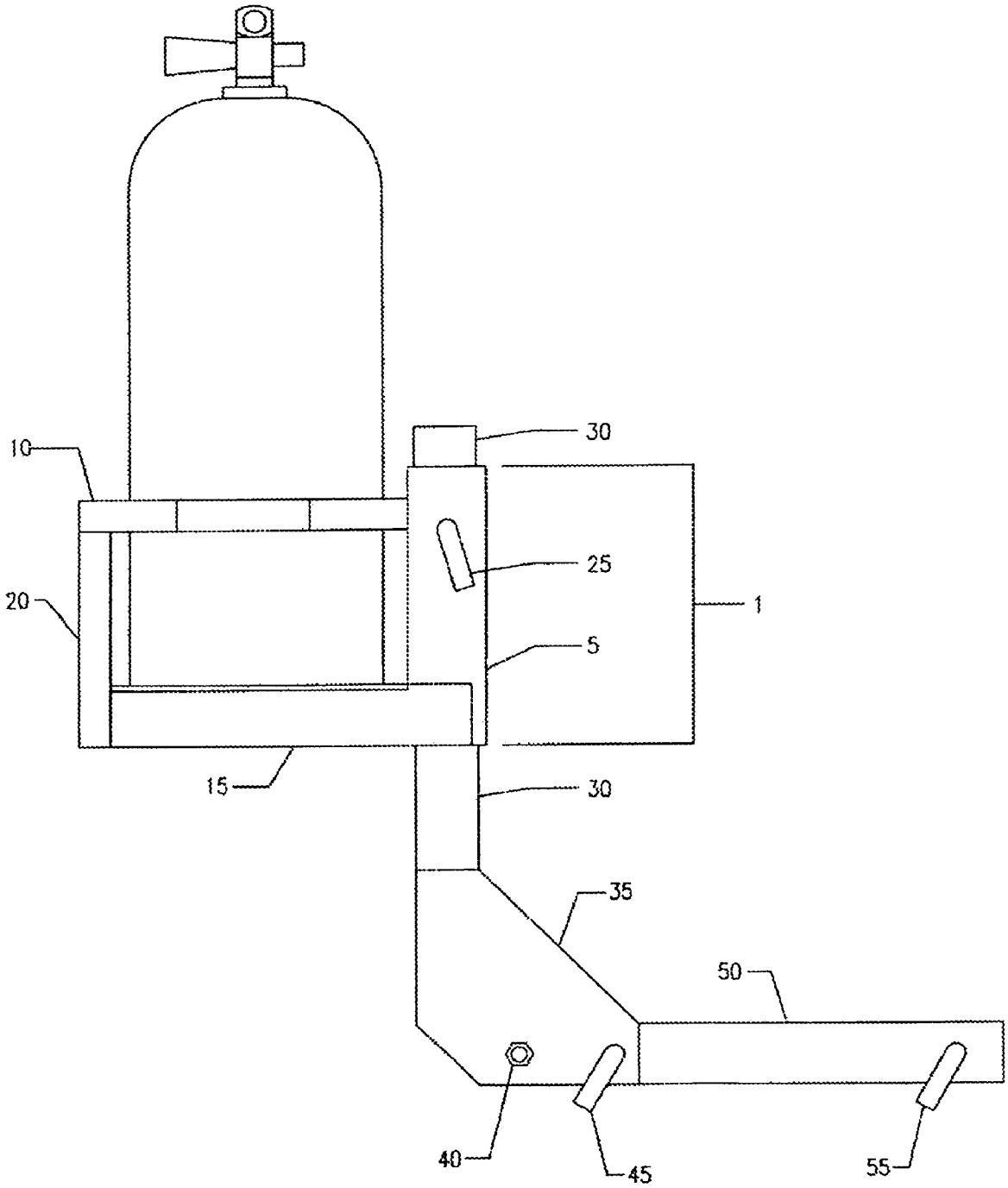
FIG. 2 shows a typical side elevation of an exemplary scuba unit support device, in accordance with an embodiment of the present invention.
Figure 3:
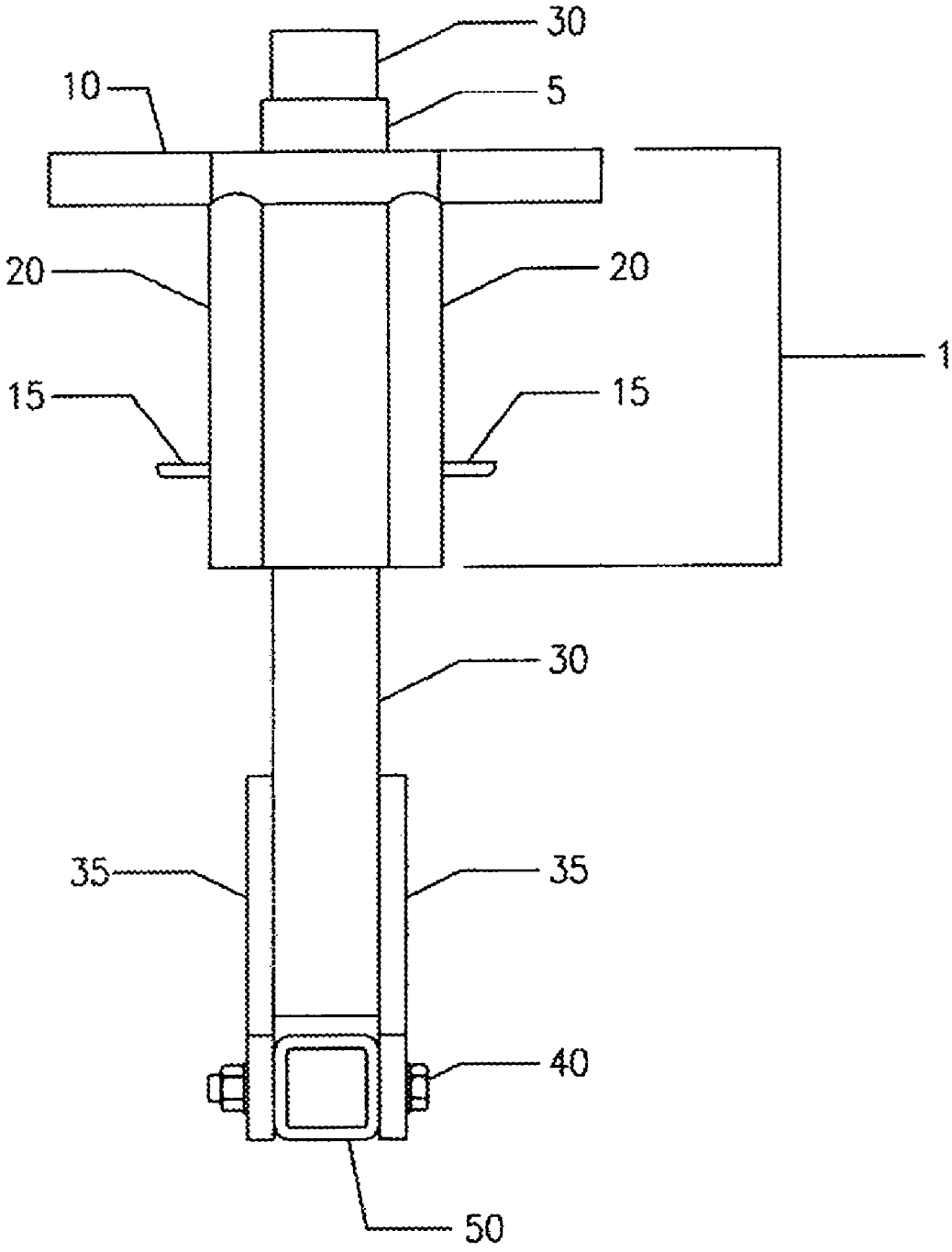
FIG. 3 shows a front view of an exemplary scuba unit support device, in accordance with an embodiment of the present invention.

FIG. 1 shows an isometric view of an exemplary scuba unit support device, in accordance with an embodiment of the present invention. FIG. 2 shows a typical side elevation of an exemplary scuba unit support device, in accordance with an embodiment of the present invention. FIG. 3 shows a front view of an exemplary scuba unit support device, in accordance with an embodiment of the present invention. For the present example, a "scuba unit" is comprised of a standard scuba cylinder or cylinders and attached buoyancy compensating device (BCD) and integrated weight system if applicable, first and second stage regulator and octopus. In the present embodiment, the scuba unit is supported by means of a scuba tank holder 1. Scuba tank holder 1 is comprised of, but not limited to, five components. A vertical holder tube 5 is the main sliding tube, which all other components of scuba tank holder 1 are attached. There is one hole drilled through the top of vertical holder tube 5. This hole is in direct line with several holes drilled through a vertical scuba tank holder support tube 30, which allows the insertion of a scuba tank holder adjusting pin 25. Adjusting pin 25, when inserted through the adjusting holes, allows for the vertical height adjustment of scuba tank holder 1.

In the present embodiment, a scuba tank retaining ring 10, or carriage, is comprised of eight sections of round steel tube which are welded to form an octagonal shaped ring. Those skilled in the art, in light of the present teachings, will recognize a multiplicity of alternative materials and shapes for scuba tank retaining ring 10. For example, without limitation, the scuba tank retaining ring could also be configured with round steel tubing rolled into a circle or square steel tube cut and configured into a square, rectangle (for twin tanks) or octagon or even from flat bar steel rolled and welded end to end to form a circle. Alternate materials for the scuba tank retaining ring include, but are not limited to, steel, aluminum or plastic, and alternate shapes for scuba tank retaining ring 10 include, but are not limited to, square, rectangular, round, and elliptical. In the present embodiment, scuba tank retaining ring 10 provides upper support to scuba tank holder 1. Scuba tank retaining ring 10 also guides the scuba tank into scuba tank holder 1. Scuba tank retaining ring 10 is attached by welds to the top of vertical holder tube 5.

In the embodiment shown, scuba tank retaining ring 10 is also supported at the front by two scuba tank retaining ring front supports 20. Retaining ring front supports 20 are welded at the top to scuba tank retaining ring 10. Scuba tank retaining ring front supports 20 are also attached at the bottom to a tank support base 15 by welding. When the scuba tank is in the scuba tank holder, the scuba tank is supported at the bottom by tank support base 15. The present embodiment is comprised of two tank support bases 15, which are attached by welding to the bottom of vertical tank holder tube 5 at a 90-degree angle.

Scuba tank holder 1, of the present embodiment, is a kind of scuba tank holding carriage that fits over and slides up and down on vertical scuba tank holder support tube 30. Vertical scuba tank holder support tube 30 has several holes drilled into the side, which allows the insertion of a scuba tank holder adjusting pin 25. To adjust the height of scuba tank holder 1, the hole in the top of vertical holder tube 5 is lined up with a hole at the desired height on vertical scuba tank holder support tube 30, and scuba tank holder adjusting pin 25 is inserted into the holes to hold scuba tank holder 1 stationary. Although a pin locking mechanism is shown, alternate embodiments of the present invention may implement any suitable removable locking mechanism that permits the secure retention of the scuba tank holder with respect to the vertical scuba tank holder support tube. For example, without limitation, alternate embodiments may implement a latch/release mechanism which allows the user the ability to lock scuba tank holder 1 to prevent theft. Moreover, alternate embodiments of the present invention, scuba tank holder may not be slidably joined to the vertical holder tube, and instead be fixedly joined (e.g., without limitation, formed together) thereto or removabley fixed to one height.

Although a pin locking mechanism is shown, alternate embodiments of the present invention may implement any suitable removable locking mechanism that permits the vertical height adjustment of the scuba tank holder.

Vertical scuba tank holder support tube 30 has two gusset attachment plates 35 welded to either side at the bottom. A horizontal receiver support 50 is attached to vertical scuba tank holder support tube 30 by gusset attachment plates 35 and is held in place by a horizontal receiver support locking pin 45. Horizontal receiver support 50 is connected to gusset plate 35 by a gusset plate bolt 40. Gusset plate bolt 40 is the pivot point which allows vertical scuba tank holder support tube 30 to swing fore and aft after removing horizontal receiver support locking pin 45. The removal of horizontal receiver support locking pin 45 also allows horizontal receiver support 50 to be rotated and positioned next to vertical scuba tank holder support tube 30, which allows for a compact profile for easy transportation in the vehicle and stowage in the home. Any known means for removabley securing the vertical scuba tank holder support tube in a fixed position may be implemented. For example, without limitation, alternate embodiments may implement latch/release mechanisms. In some embodiments of the present invention, instead of a locking pin and pivot joint mechanism, the pivot joint is configured with a locking mechanism that optionally has one or more selectable locking angles. In alternate embodiments of the present invention, do not include locking pin 45 or any such removable securing means, and instead the joint between the horizontal receiver support and the vertical scuba tank holder support tube is fixed. In yet other embodiments of the present invention, a removable fixing mechanism replaces the pivoting joint and is used to selectively fix or dislodge the joint between the horizontal receiver support and the vertical scuba tank holder support tube such that the whole vertical scuba tank holder section, potentially carrying at least one scuba tank, can be dislodged from the horizontal receiver support section and transported as needed.

In the present embodiment, horizontal receiver support 50 is inserted into a hitch receiver attached to a vehicle by a hitch receiver support locking pin 55. This prevents the present embodiment from sliding out of the vehicle's hitch receiver when in use. In some embodiments of the present invention, the hitch receiver support locking pin could also comprise a locking mechanism to discourage theft of the invention while attached to the vehicle.

In a typical application of the present embodiment, a scuba unit support device is attached to the rear of a car or truck via a hitch receiver. The scuba unit is then lifted and placed in scuba tank holder 1 of the scuba unit support device. The scuba unit is now staged at a comfortable height for the diver to assemble his equipment. After the scuba gear is assembled, it may remain safely supported in the tank holder off the ground and away from potential damage. When the diver is ready to don his gear all he needs to do is back up to the scuba unit support device and insert his arms through the shoulder straps of the buoyancy compensating device. He then can adjust the shoulder straps, cummerbund, and other retaining straps for a proper fit. After donning the scuba unit all the diver must do is straighten his legs and back, lean forward to lift the scuba tank out of the scuba tank retaining ring 10 and walk away from the scuba unit support device with his gear properly adjusted and secured. The present embodiment would be particularly useful for scuba divers who primarily dive from the shores of lakes, quarries, rivers and oceans. After a diver assembles and dons his or her scuba gear it is usually just a short walk to the water. After the dive is completed the diver backs up to the scuba unit support device, leans forward to lift the tank into upper retaining ring 10, which guides the tank into scuba tank holder 1. He then un-straps himself from the scuba unit. The diver is now able to leave the scuba gear safely suspended off the ground. He can now remove the regulator and BCD from the empty scuba tank and allows the diver to relatively easily change tanks for his next dive (at a comfortable height) or is now able to disassemble his gear without bending over or having the gear lying on the ground. The scuba tank holder 1 could also have integrated in its present for a regulator and BCD holder. This would be useful during the changing of scuba tanks. When a diver changes a tank he must first remove the regulator and BCD from the tank. After removing the regulator and BCD this holder would safely support the regulator and BCD until a new scuba tank is provided.

Figure 4:
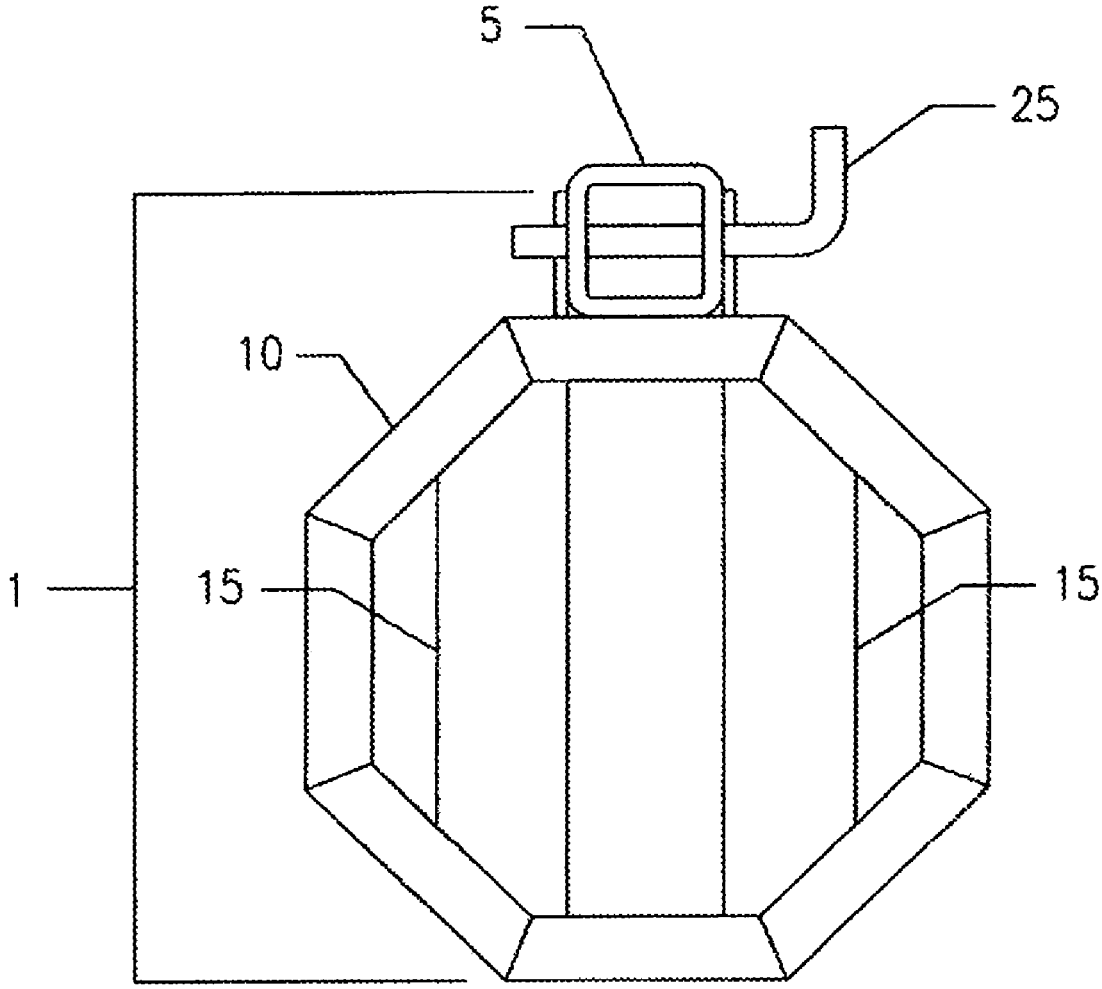
FIG. 4 shows a top view of an exemplary scuba tank holder from a scuba unit support device, in accordance with an embodiment of the present invention.

FIG. 4 illustrates an exemplary top view of the scuba unit support device shown in FIG. 1, in accordance with an embodiment of the present invention. Note that gusset attachment plate 35, gusset plate bolt 40, horizontal receiver support locking pin 45, horizontal receiver support 50, and horizontal receiver support locking pin 55 have been omitted from this drawing for the sake of clarity. In the present embodiment, tank holder 1 holds the scuba unit steady in the scuba unit support device. Vertical holder tube 5 attaches scuba tank holder 1 to the rest of the scuba unit support system. In the present embodiment, scuba tank retaining ring 10 is connected to the upper portion of vertical holder tube 5. When the scuba tank is in scuba tank holder 1, the scuba tank rests on tank support base 15, and scuba tank retaining ring 10 stabilizes the scuba tank. In the present embodiment, the vertical height of scuba tank holder 1 can be adjusted by sliding vertical holder tube 5 up or down along vertical scuba tank holder support tube 30, shown in FIGS. 1 through 3, and holding scuba tank holder 1 in place with scuba tank holder adjusting pin 25.

Figure 5:
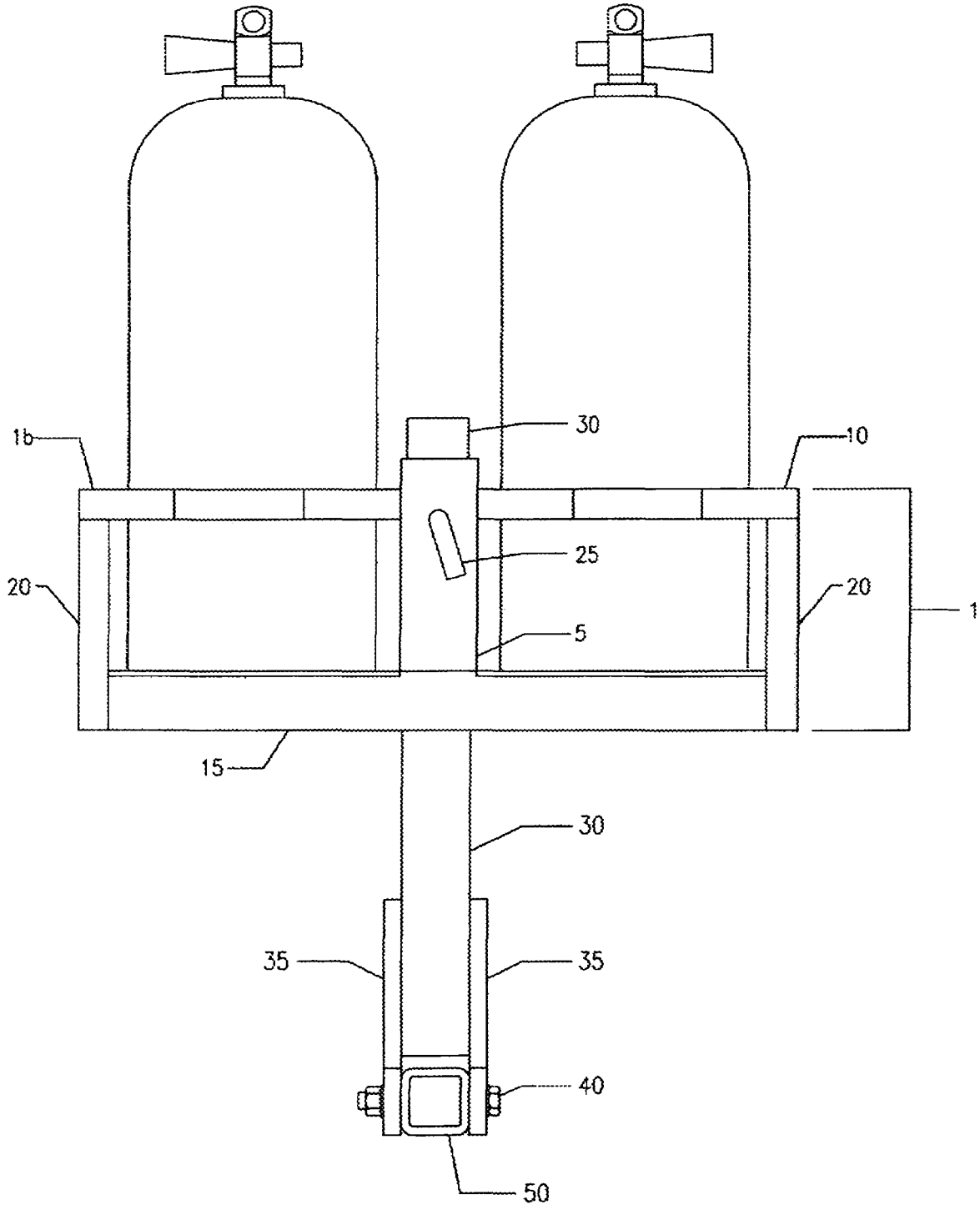
FIG. 5 illustrates a front view of an exemplary scuba unit support device that is able to support two scuba tanks in accordance with an embodiment of the present invention.
Figure 6:
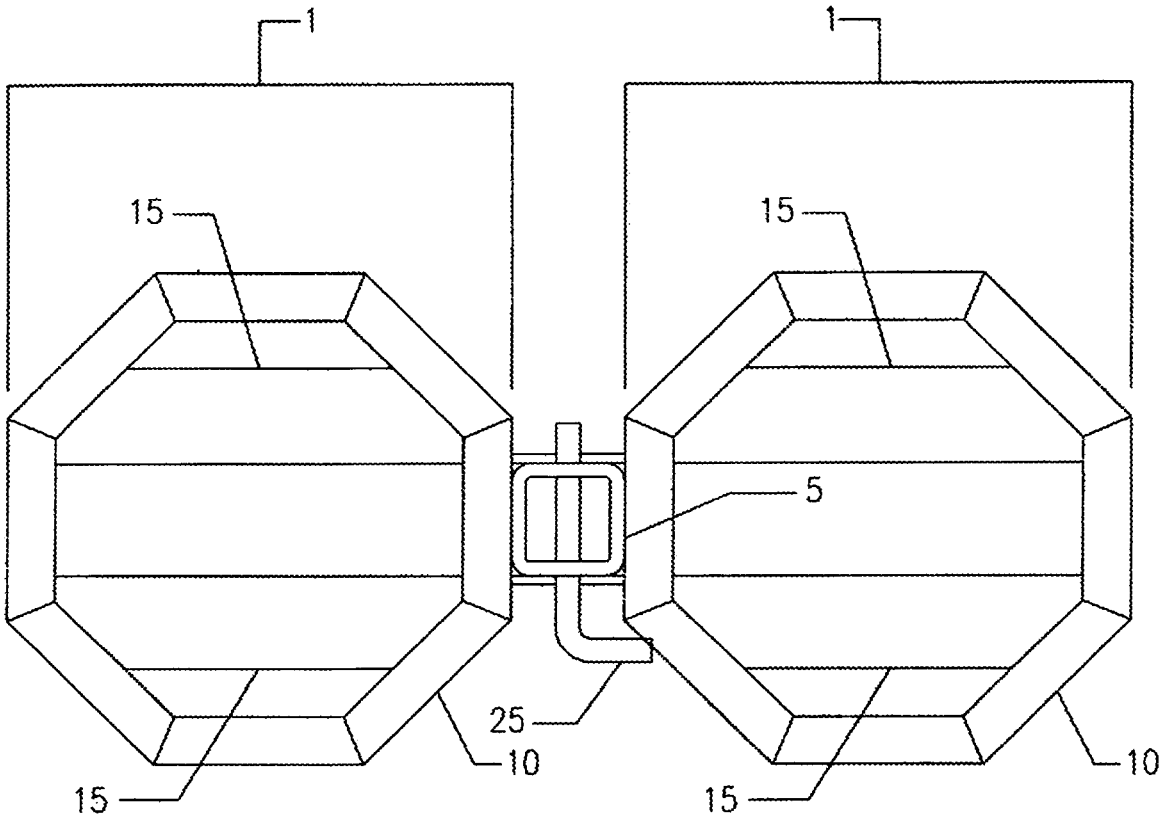
FIG. 6 illustrates a top view of an exemplary scuba unit support device that is able to support two scuba tanks in accordance with an embodiment of the present invention.

FIG. 5 illustrates a front view of an exemplary scuba unit support device that is able to support two scuba tanks in accordance with an embodiment of the present invention. FIG. 6 illustrates a top view of the scuba tank holder from a scuba unit support device of FIG. 5, in accordance with an embodiment of the present invention. In the present embodiment, the scuba unit support device is comprised of two scuba tank holders 1. Both of the scuba tank holders are comprised of one upper tank retaining ring 10 and two tank support bases 15. Each scuba tank holder 1 is attached to opposite sides of vertical holder tube 5. In alternate embodiments of the present invention, the tank support device could also be arranged so that the two scuba tanks are situated side by side or at a 45 degree angle from the vertical scuba tank holder tube 5, which would put the two scuba tank holders 1 at a 90 degree from each other as opposed to back to back as in the current embodiment.

In the present embodiment, vertical holder tube 5 slides over vertical scuba tank holder support tube 30 and is held in a chosen vertical position with scuba tank holder adjusting pin 25. In the present embodiment, vertical scuba tank holder support tube 30 has two gusset attachment plates 35 welded to either side at the bottom. Horizontal receiver support 50 is attached to vertical scuba tank holder support tube 30 by gusset attachment plates 35. Horizontal receiver support 50 is connected to gusset plates 35 by gusset plate bolts 40.

Figure 7:
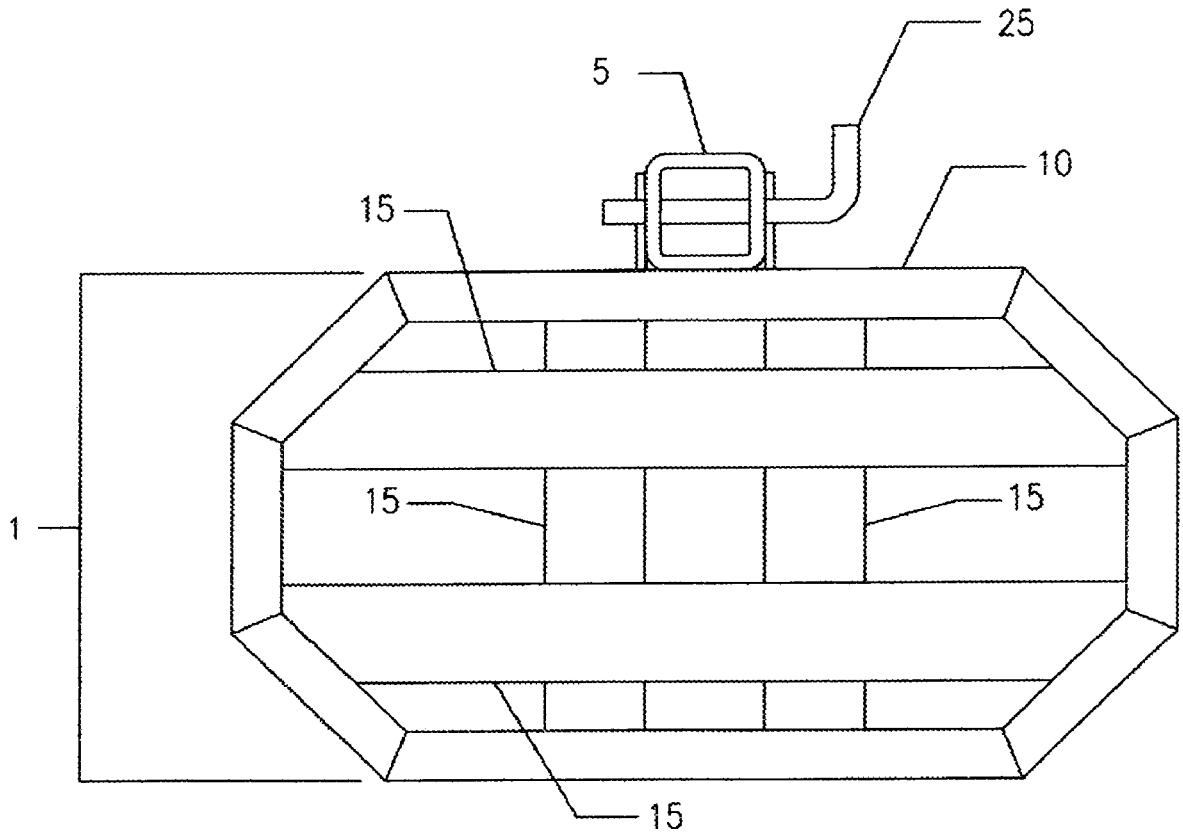
FIG. 7 shows a top view of an exemplary scuba tank holder from a scuba unit support device that will support a dual tank scuba unit, which is used primarily for technical diving, in accordance with an embodiment of the present invention.

FIG. 7 shows an exemplary top view of the scuba unit support device shown in FIG. 6, in accordance with an embodiment of the present invention. In this embodiment, which is often used for technical diving, the structure of the scuba unit support device is very similar to that of the embodiment illustrated in FIGS. 1 through 3. However, in the present embodiment, scuba tank retaining ring 10 is wide enough to accommodate a dual tank scuba unit.

Figure 8:
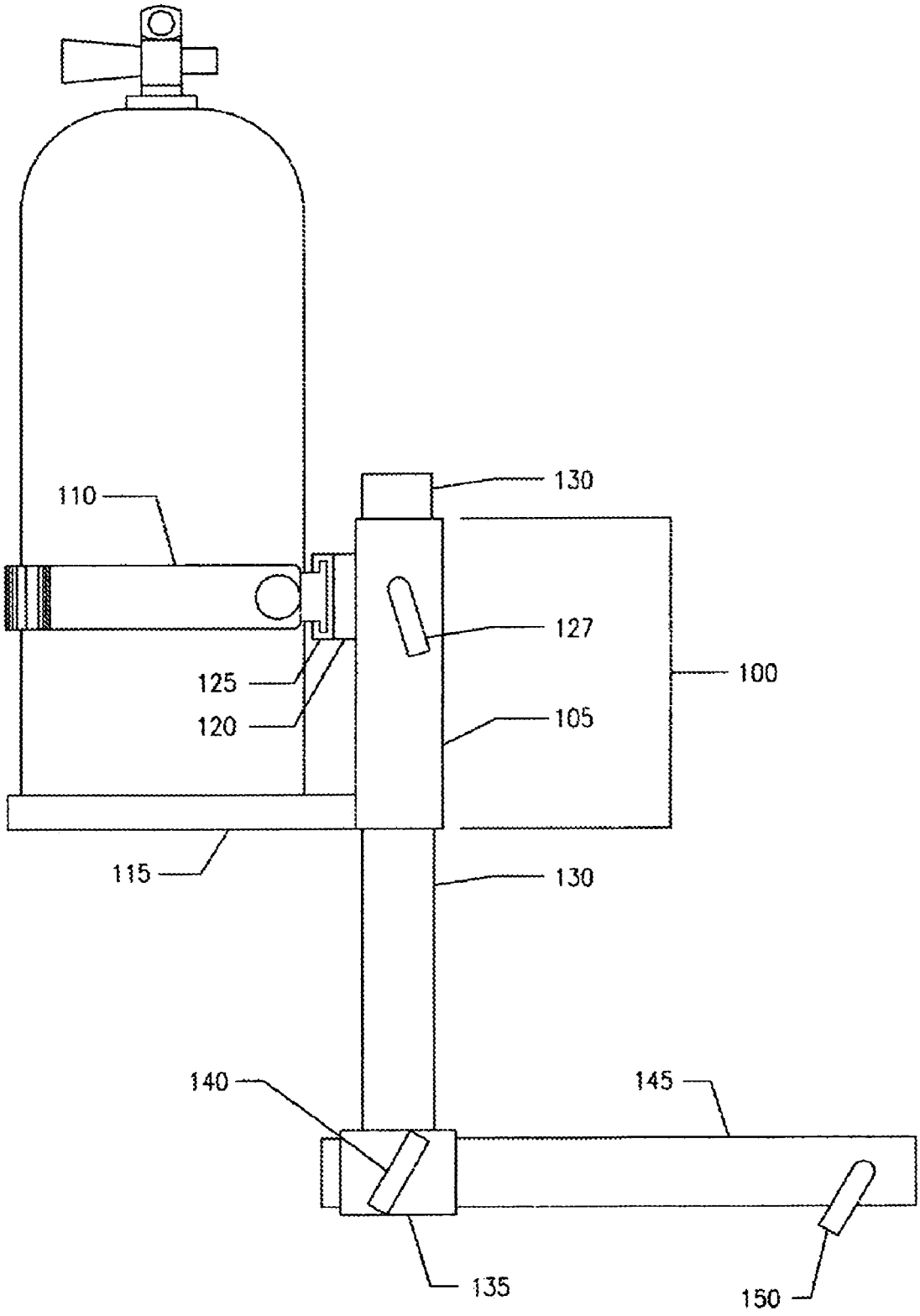
FIG. 8 illustrates a side view of an exemplary scuba unit support device incorporating a scuba tank bracket, in accordance with an embodiment of the present invention.
Figure 9:
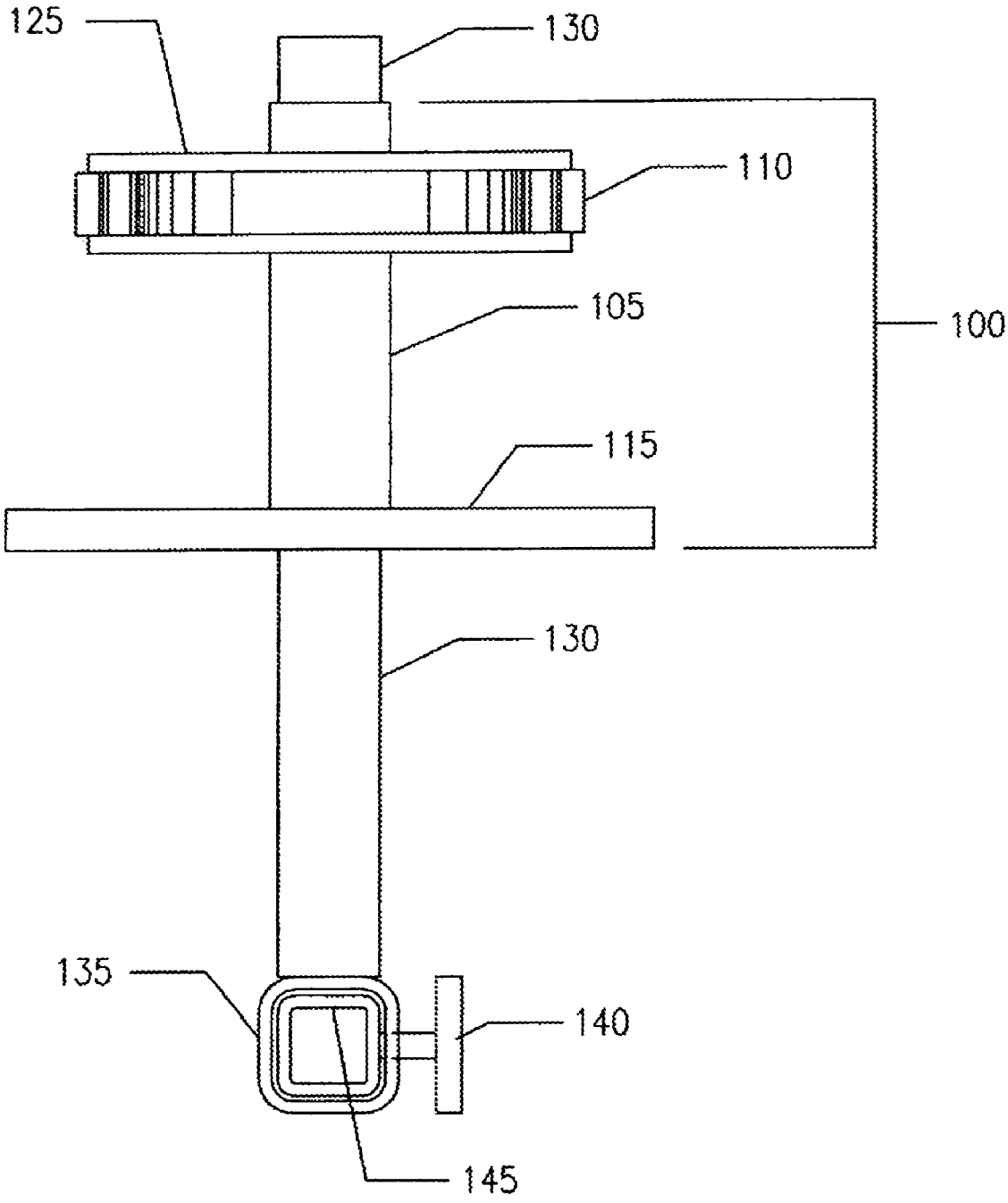
FIG. 9 shows a front view of an exemplary scuba unit support device incorporating a scuba tank bracket, in accordance with an embodiment of the present invention.
Figure 10:
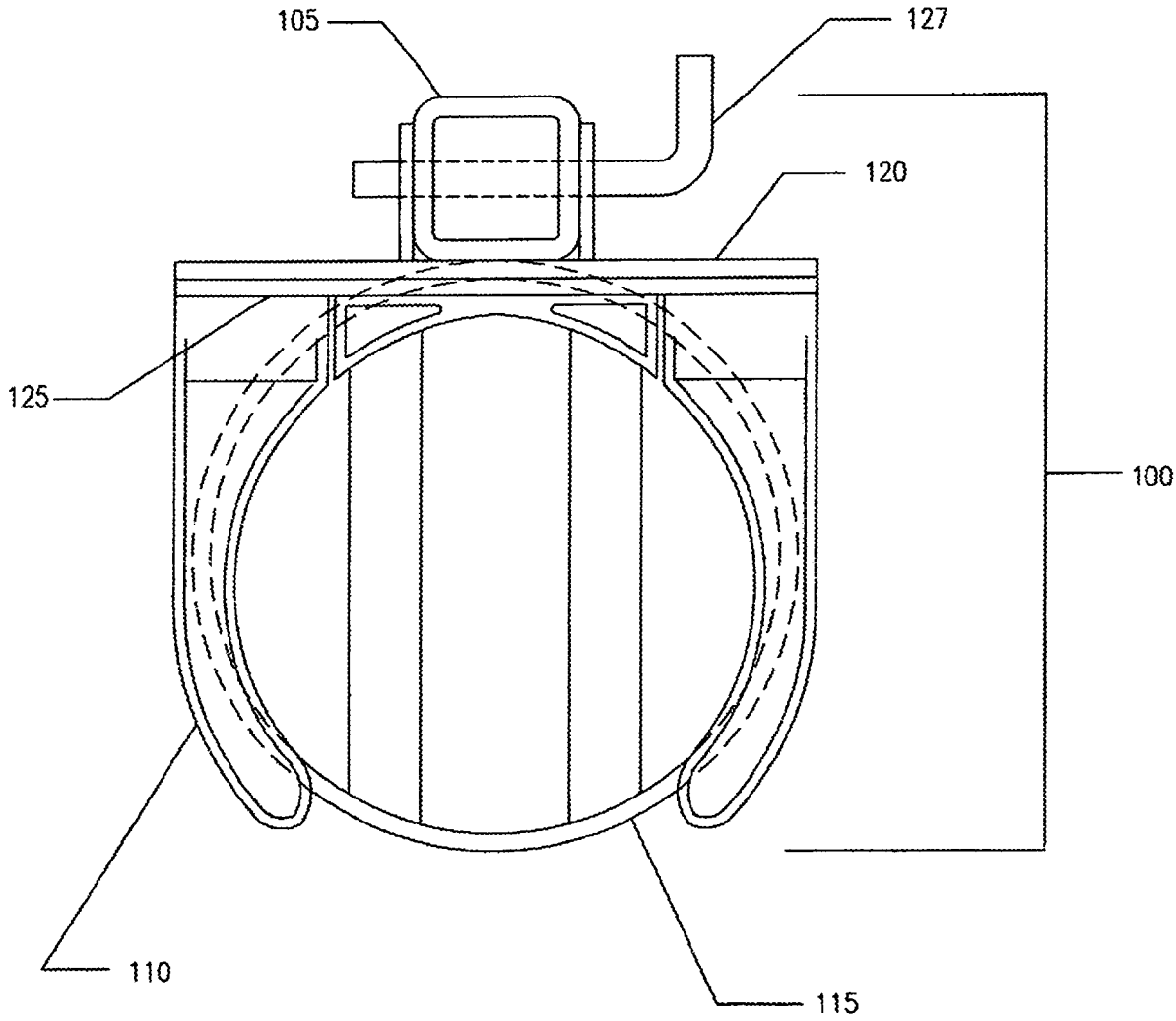
FIG. 10 shows a top view of an exemplary scuba tank holder from a scuba unit support device incorporating a scuba tank bracket, in accordance with an embodiment of the present invention.

In an alternate embodiment of the present invention a scuba tank bracket such as, but not limited to, the "Roll Control System Adjustable Dive Tank Bracket" (U.S. Pat. No. 5,533,701) is integrated into the scuba unit support device. FIG. 8 illustrates a side view of an exemplary scuba unit support device incorporating a scuba tank bracket, in accordance with an embodiment of the present invention. FIG. 9 shows a front view of an exemplary scuba unit support device incorporating a scuba tank bracket, in accordance with an embodiment of the present invention. FIG. 10 shows a top view of an exemplary scuba tank holder from a scuba unit support device incorporating a scuba tank bracket, in accordance with an embodiment of the present invention. The "Roll Control System Adjustable Dive Tank Bracket" is used conventionally for securing dive tanks in an upright position in a boat. This allows the scuba tanks to be safely stored in a vertical position (requiring less floor space) while transporting to a dive location. In the current embodiment, the scuba unit is supported by means of a scuba tank holder 100. A vertical holder tube 105 is the main sliding tube to which all of the other components of scuba tank holder 100 are attached. Scuba tank holder 100 fits over and slides up and down on vertical scuba tank holder support tube 130. There is one hole drilled through the top of vertical holder tube 105. This hole is in direct line with several holes drilled through a vertical scuba tank holder support tube 130, which allows the insertion of a scuba tank holder adjusting pin 127. Adjusting pin 127, when inserted through the adjusting holes, allows for the vertical height adjustment of scuba tank holder 100.

In the present embodiment, a scuba tank bracket 110 is connected to an aluminum track 125 by sliding scuba tank bracket 110 into the groove in aluminum track 125. Aluminum track 125 is then attached to vertical holder tube 105 by means of a flat bar bracket 120 attached by rivets on either side. The rivets are preferably flush on the inside of aluminum track 125. This allows scuba tank bracket 110 to slide onto aluminum track 125 without interference. Those skilled in the art will recognize, in light of the present teachings, a multiplicity of alternative techniques for attaching aluminum track 125 to flat bar bracket 120 such as, but not limited to screws or epoxy resin. Flat bar bracket 120 is welded to vertical scuba tank holder tube 105. In the present embodiment, the scuba tank is supported at the bottom by a circular steel support base with attached parallel steel flat bars 115 that act as a floor and thereby supports the weight of the scuba tank and attached gear. In alternate embodiments, the parallel flat bars could be replaced by an expanded metal mesh or other similar material. The circular steel support base 115 may be attached by being welded to the bottom of vertical holder tube 105 at a 90-degree angle. In some embodiments of the present invention, this attachment is alternatively achieved by means of a hinge, which allows the scuba tank support base the ability to fold flat for easy stowage and transportation.

Vertical scuba tank holder support tube 130 is welded to a horizontal adjustment tube 135 which allows for fore and aft adjustment of the scuba tank holder 100. This would allow the invention the ability to conform to a wide array of truck tail gate sizes as when the tail gate is extended. This fore and aft adjustment is secured to the horizontal receiver support 145 by a horizontal adjustment tube locking screw 140. After removing the scuba tank holder 100 from the vertical scuba tank holder support tube 130 the diver is then able to remove the vertical scuba tank holder support tube 130 and attached horizontal adjustment tube 135 by turning the horizontal adjustment tube locking screw 140 and sliding the unit forward and off of the horizontal receiver support 145, which allows for a compact profile for easy transportation in the vehicle and stowage in the home. In the present embodiment, horizontal receiver support 150 is inserted into a vehicle hitch receiver attached to a vehicle and fixed to the hitch receiver by a hitch receiver support locking pin 155. This prevents the present embodiment from sliding out of the vehicle's hitch receiver when in use. The present embodiment is designed to attach to an owner supplied hitch receiver, however it is contemplated that the present embodiment could fit a wide range of vehicle without a hitch receiver with the addition of other attachment devices designed specifically for a vehicle bumper or an open car trunk. The present embodiment could also be adapted to free standing with the addition of a vertical support stand which could be set up in the field by the diver. The present embodiment is not designed as a transportation device and is preferably a support device, however, if required by the particular application, those skilled in the art will readily recognize how to adapt the teachings of the present invention to transport scuba air tanks affixed to the rear of a vehicle if so desired.

In a typical application of the present embodiment, a scuba unit support device is attached to the rear of a car or truck via a hitch receiver. The scuba unit is then placed in scuba tank bracket 110 of the scuba unit support device. The scuba unit is now at a comfortable height for the diver to assemble his equipment. After the scuba gear is assembled, it may remain safely supported in scuba tank holder 100 off the ground and away from potential damage. When the diver is ready to don his gear all he needs to do is back up to the scuba unit support device and insert his arms through the shoulder straps of the buoyancy compensating device. He then can adjust the shoulder straps, cummerbund, and other retaining straps for a proper fit. After donning the scuba unit all the diver must now do is make a slight tug on the attached scuba unit walk away from the scuba unit support device with his gear properly adjusted and secured. The present embodiment allows the diver to don his scuba gear without having to lift the tank vertically to remove it from the tank holder. After the dive is completed, the diver only needs to back up to the holder and push it into place in the plastic scuba tank bracket 110 and un-strap himself from the scuba unit. In the preferred implementation, the diver does not need to bend forward and lift the scuba tank to place it into the holder. The diver is now able to leave the scuba gear safely suspended off the ground. He can now change tanks for his next dive (at a comfortable height) or is now able to disassemble his gear without bending over or having the gear lying on the ground.

Figure 11:
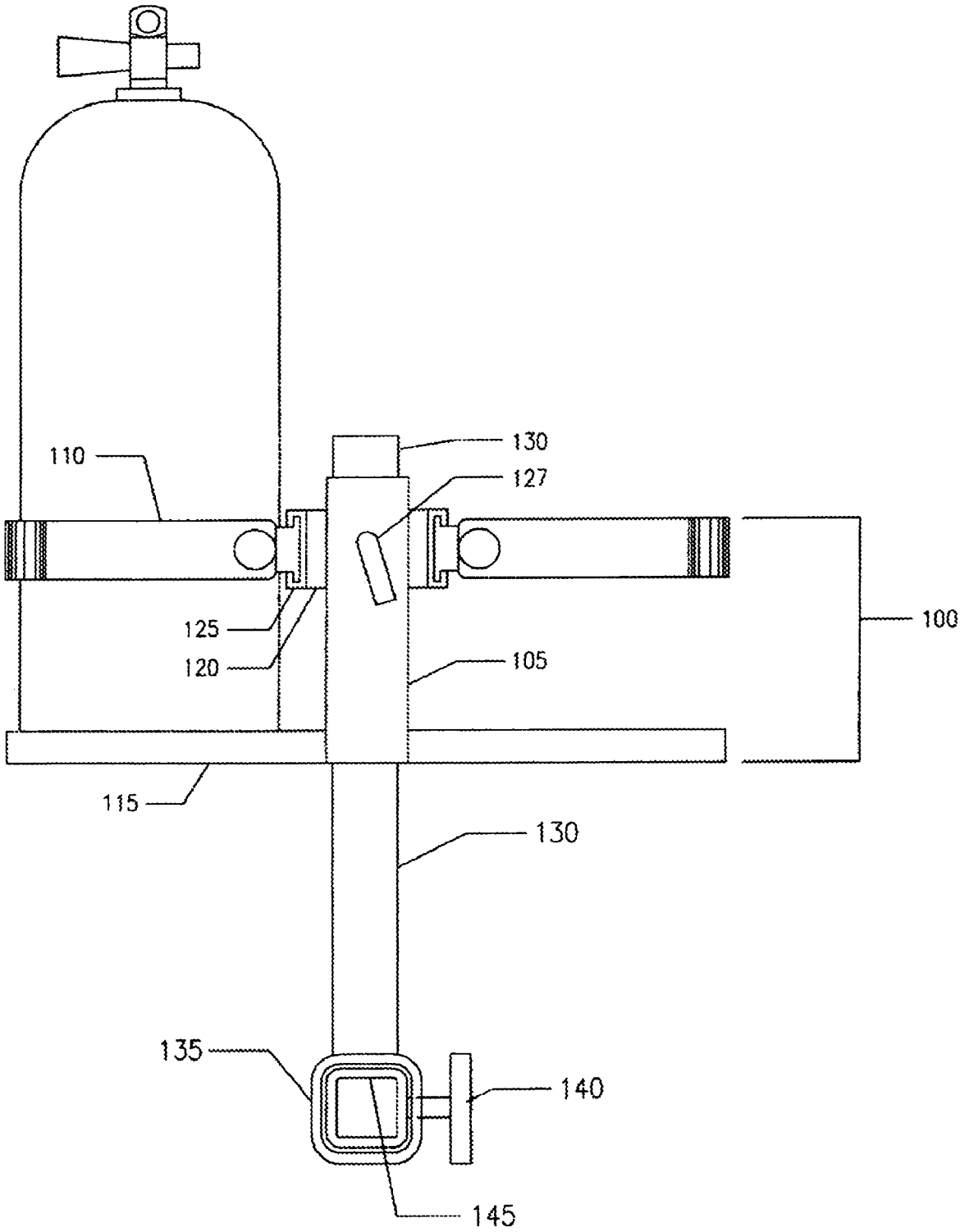
FIG. 11 illustrates a side view of an exemplary scuba unit support device that is configured to hold two separate scuba tanks incorporating a scuba tank bracket, in accordance with an embodiment of the present invention.
Figure 12:
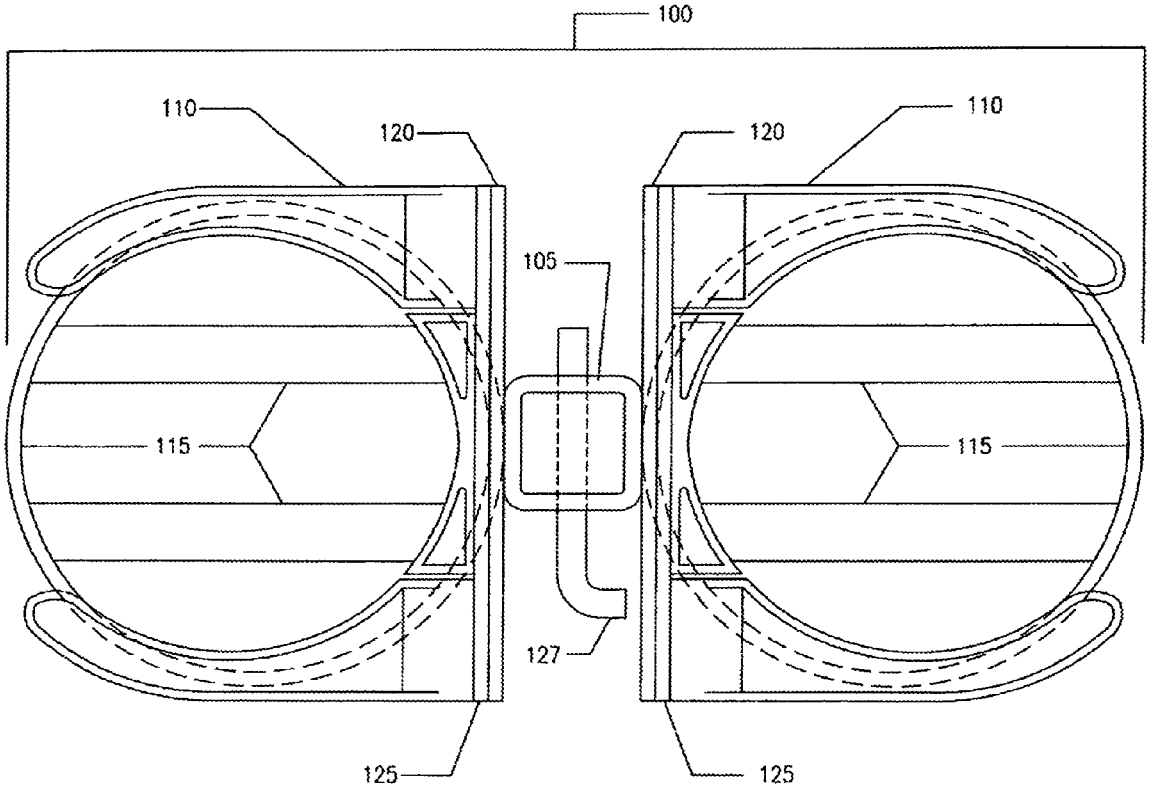
FIG. 12 illustrates a top view of the scuba tank holder of FIG. 11, in accordance with an embodiment of the present invention.

FIG. 11 illustrates a side view of an exemplary scuba unit support device that is configured to hold two separate scuba tanks and incorporating a scuba tank bracket, in accordance with an embodiment of the present invention. FIG. 12 illustrates a top view of the scuba tank holder of FIG. 11, in accordance with an embodiment of the present invention. In the present embodiment, scuba tank holder 100 is comprised of, but not limited to, one vertical holder tube 105, two scuba tank holder brackets 110, four scuba tank base supports 115, two aluminum tracks 125, and one scuba tank holder tube adjusting pin 127. In the present embodiment, vertical scuba tank holder support tube 130 has two gusset attachment plates 135 welded to either side at the bottom. Horizontal receiver support 150 is attached to vertical scuba tank holder support tube 130 by gusset attachment plates 135. Horizontal receiver support 150 is connected to gusset plates 135 by gusset plate bolt 140.

The foregoing embodiments may be modified to allow the attachment of multiple scuba tank holders 1 and 100 to a vehicle. This can be achieved by attaching a horizontal scuba tank holder tube to the existing vertical scuba tank holder tube 5 and 105 by welding. This additional horizontal scuba tank holder tube enables the scuba tank holder to be slid over a horizontal tube much like the horizontal receiver support 50 and 145 in the previous embodiments.

The present embodiments described herein may be easily modified to accommodate a myriad of equipment requirements depending upon the needs of the particular application. The width of the scuba tank holder can be extended as needed to support additional tanks, equipment and/or diving gear. Additional attachments may also be provided to support other specialized diving gear often used in the technical and cave diving disciplines.

Although the foregoing embodiments were described in term joining structural members by way of welding, those skilled in the art will readily recognize a multiplicity of alternative and suitable joining techniques depending upon the needs of the particular application. Similarly, alternative manufacturing techniques to those described may be used to achieve similar results; for example, without limitation, instead of welding or joining separate members together, all members of a described structure may be formed or molded instead of assembled or joined.

Having fully described at least one embodiment of the present invention, other equivalent or alternative methods of implementing a scuba unit support device with a vertically adjustable hitch receiver according to the present invention will be apparent to those skilled in the art. The invention has been described above by way of example, and the specific embodiments disclosed are not intended to limit the invention to the particular forms disclosed. The invention is thus to cover all modifications, equivalents, and alternatives falling within the spirit and scope of the following claims.

What is claimed is:

1. An apparatus for securely holding scuba tanks via a vehicle hitch, the apparatus comprising:

a vertical support tube that provides a rigid structural support for other components of said scuba tank holder apparatus to be joined to;

a holder carriage, said holder carriage being operable for holding at least one said scuba tank and is configured to be structurally suspended on said vertical support tube by slideably joining thereto, thereby being constrained to longitudinal translation along the length of said vertical support tube;

a first locking mechanism, said first locking mechanism being operable for removably fixing the longitudinal translation of said holder carriage with respect to said vertical support tube, said first locking mechanism being configured into said vertical support tube and/or said tank holder carriage and operable for support a load placed into said holder carriage; and a hitch receiving member; in which a first end portion of said hitch receiving member is joined to a lower portion of said vertical support tube, and a second end portion is configured to be operable for being securely joined to a vehicle hitch, thereby structurally supporting said vertical support tube and associated components when joined thereto.

2. The scuba tank holding apparatus of claim 1, in which said first locking mechanism is comprised of holes drilled through a top portion of said vertical support tube such that an adjusting pin can be passed strait through two paired drilled holes that are configured at opposite sides of said vertical support tube.

3. The scuba tank holding apparatus of claim 2, in which said vertical support tube comprises a plurality of said paired drilled holes, thereby providing a plurality of fixing positions onto said vertical support tube.

4. The scuba tank holding apparatus of claim 1, in which the joining of said receiving member and said vertical support tube is by way of a pivoting joint.

5. The scuba tank holding apparatus of claim 1, in which said second end portion that is configured to be operable for being securely joined to a vehicle hitch, comprises a theft prevention device.

6. The scuba tank holding apparatus of claim 1 in which the joining of said receiving member and said vertical support tube is by way of a pivoting joint comprising a second locking mechanism that is operable to selectively allow said vertical support tube to pivotally rotate or be fixed.

7. The scuba tank holding apparatus of claim 1, in which said holder carriage is configure to properly hold one scuba tank.

8. The scuba tank holding apparatus of claim 1, in which said holder carriage is configure to properly hold two scuba tanks.

9. The scuba tank holding apparatus of claim 8, in which said holder carriage is configured to hold the tanks on opposite sides of said vertical support tube and oriented along a line that is generally perpendicular to said hitch receiving member.

10. The scuba tank holding apparatus of claim 8, in which said holder carriage is configured to hold the tanks symmetrically with respect to a plane that includes said vertical support tube.

11. The scuba tank holding apparatus of claim 1, in which said holder carriage comprises an upper adjustable dive tank bracket for securing from the top and in an upright position at least one scuba tank sitting in said holder carriage.

12. The scuba tank holding apparatus of claim 1, in which said holder carriage is comprised of a lower tank support plate and upper adjustable strap for securing from the top and in an upright position at least one scuba tank sitting in said holder carriage.

13. The scuba tank holding apparatus of claim 1, in which said holder carriage is further joined to said vertical support tube such that in addition to the longitudinal translation degree of freedom, said holder carriage can be pivotally rotated with respect to said vertical support tube.

14. The scuba tank holding apparatus of claim 1, further comprising a horizontal carriage support member joining a plurality of said holder carriages together.

15. An apparatus for securely holding scuba tanks via a vehicle hitch, the apparatus comprising:

means for providing a rigid, vertical structural support that other components of said scuba tank holder apparatus may be joined to;

means for holding and suspending at least one said scuba tank on said vertical support means;

means for removably fixing said tank holder means with respect to said vertical support means; and means for joining a lower portion of said vertical support means to a vehicle hitch, thereby structurally supporting said vertical support means and associated components when joined thereto.

16. The scuba tank holding apparatus of claim 15, in which said tank holder means comprises a means for securing from the top and in an upright position at least one scuba tank sitting in said tank holder means.

17. An apparatus for securely holding scuba tanks via a vehicle hitch, the apparatus comprising:

a vertical support tube that provides a rigid structural support for other components of said scuba tank holder apparatus to be joined to;

a holder carriage, said holder carriage being operable for holding at least one said scuba tank and is configured to be structurally suspended on said vertical support tube by slideably joining thereto, thereby being constrained to longitudinal translation along the length of said vertical support tube;

a first locking mechanism that is comprised of holes drilled through a top portion of said vertical support tube such that an adjusting pin can be passed strait through two paired drilled holes that are configured at opposite sides of said vertical support tube, said first locking mechanism being operable for removably fixing the longitudinal translation of said holder carriage with respect to said vertical support tube, said first locking mechanism being configured into said vertical support tube and/or said tank holder carriage and operable for support a load placed into said holder carriage; and a hitch receiving member; in which a first end portion of said hitch receiving member is pivotally joined to a lower portion of said vertical support tube, the pivotal joining being by way of a pivoting joint comprising a second locking mechanism that cooperates to selectively allow said vertical support tube to pivotally rotate or be fixed, and hitch receiving member further comprising a second end portion that is configured to be operable for being securely joined to a vehicle hitch, thereby structurally supporting said vertical support tube and associated components when joined thereto.

* * * * *